US005167492A

United States Patent [19]

Kent et al.

[11] Patent Number: 5,167,492

[45] Date of Patent: Dec. 1, 1992

[54] FLUID PUMPING ASSEMBLY HAVING A LUBRICATION CIRCUIT FUNCTIONING INDEPENDENT OF THE ORIENTATION OF THE FLUID PUMPING ASSEMBLY

[75] Inventors: Scott E. Kent, Albion; Edward D. Pettitt, Burt, both of N.Y.

[73] Assignee: General Motors Corporation, Detroit, Mich.

[21] Appl. No.: 747,073

[22] Filed: Aug. 19, 1991

[51] Int. Cl.[5] ..... F04B 27/08

[52] U.S. Cl. ..... 417/222.2; 184/6.17

[58] Field of Search ..... 417/222 S; 184/6.17, 184/6.2; 92/12.2

[56] References Cited

U.S. PATENT DOCUMENTS

| | | | |
|---|---|---|---|
| 920,421 | 4/1909 | Boland . | |
| 3,587,406 | 6/1971 | Gannaway et al. . | |
| 4,283,997 | 8/1981 | Takahashi et al. | 417/269 X |
| 4,290,345 | 9/1981 | Hiraga et al. | 417/269 X |
| 4,392,788 | 7/1983 | Nakamura et al. | 417/269 |
| 4,428,718 | 1/1984 | Skinner | 417/222 S |
| 4,432,702 | 2/1984 | Honzawa et al. | 417/269 |
| 4,621,983 | 11/1986 | Thomas et al. | 417/222 R |
| 4,815,358 | 3/1989 | Smith | 417/222 S |
| 4,872,814 | 10/1989 | Skinner et al. | 417/222 S |

FOREIGN PATENT DOCUMENTS 63-280876 11/1988 Japan .

*Primary Examiner*—Leonard E. Smith

*Attorney, Agent, or Firm*—Ronald L. Phillips

[57] ABSTRACT

A fluid pumping assembly including a control valve mounted in a control valve boss having an inlet exposed to the elevated discharge pressure of the discharge chamber and an outlet exposed to the reduced pressure of the crank case. The control valve is responsive to pressure differentials between the crank case and the discharge chamber and provides a fluid path between the crank case and the discharge chamber to allow lubricating fluid from the discharge chamber to be injected into the crank case through the fluid path provided by the control valve under the influence of the pressure differential existing between the crank case and the discharge chamber. The control valve boss partially bifurcates the discharge chamber to form first and second reservoirs such that oil is disposed on either side of the control valve boss in the first and second reservoirs. The assembly further includes an oil pick-up tube providing fluid communication between the control valve inlet and both the first and second oil reservoirs on either side of the control valve boss for delivering oil from both of the first and second reservoirs to the control valve inlet independent of the orientation of the fluid pumping assembly.

2 Claims, 2 Drawing Sheets

FIG - 2
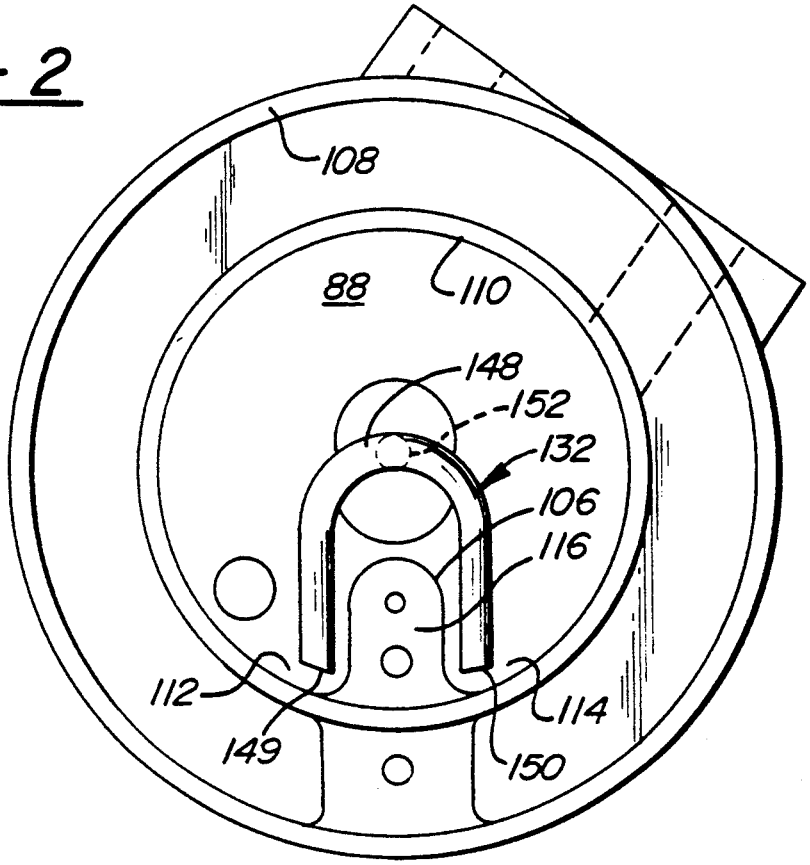
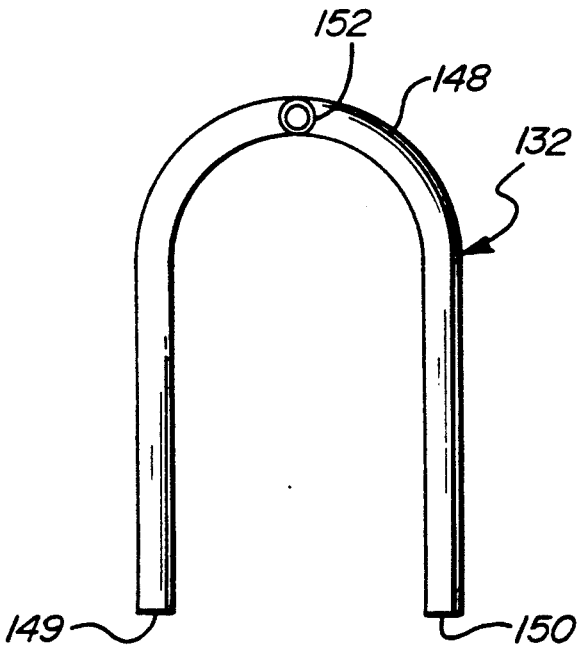
FIG - 3
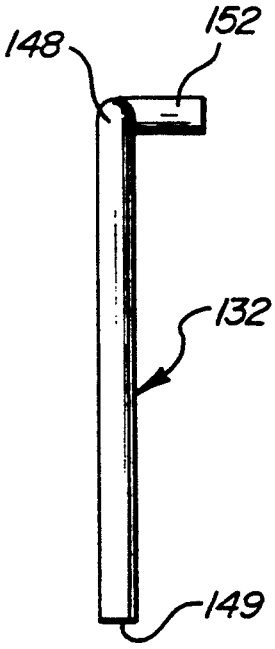
FIG - 4

FLUID PUMPING ASSEMBLY HAVING A LUBRICATION CIRCUIT FUNCTIONING INDEPENDENT OF THE ORIENTATION OF THE FLUID PUMPING ASSEMBLY

BACKGROUND OF THE INVENTION (1) Technical Field

The subject invention is directed toward a lubrication circuit for a fluid pumping assembly and more specifically to a fluid pumping assembly having a lubrication circuit communicating between a crank case operating at a first pressure and a discharge chamber operating at a second elevated pressure through a control valve.

(2) Description Of The Prior Art

The lubrication of the mechanical working parts housed within a fluid pumping assembly has always been a concern for design engineers. Excessive wear and heat generated by the working parts of a pump can quickly erode optimum working parameters such as volumetric efficiency and can ultimately lead to seizure or other types of failure in the pump.

Proper lubrication is especially important in fluid pumping assemblies such as compressors used to recirculate a refrigerant in an automotive air conditioning application. In compressors of this type, it is important to keep working parts lubricated while limiting the amount of oil which is mixed with the refrigerant so as to prevent excessive oil in the refrigeration circuit. An increased amount of oil in the refrigeration circuit causes a deterioration in the performance of the heat exchanger of the air conditioning system, leading to an inferior refrigerating capacity of the system. Further, the increased amount of oil in the refrigeration circuit causes a shortage of oil within the compressor and consequently insufficient oil to the working parts resulting in seizure or excessive wear as indicated above.

In order to avoid these problems, prior art compressors often include complex lubrication circuits including multiple passages bored through the structure of the housing, valve plate, drive shaft and other elements of the compressor. Examples of compressors having such complex lubrication circuits can be found at U.S. Pat. No. 4,621,983 issued to Thomas et al on Nov. 11, 1986; U.S. Pat. No. 4,432,702 issued to Honzawa on Feb. 21, 1984; U.S. Pat. No. 4,392,788 issued to Nakamura et al on Jul. 12, 1983; U.S. Pat. No. 4,283,997 issued to Takahashi et al on Aug. 18, 1981; U.S. Pat. No. 4,290,345 issued to Hiraga et al on Sep. 22, 1981; U.S. Pat. No. 3,587,406 issued to Gannaway et al on Jun. 28, 1971; and Japanese Patent No. 63-280876 issued to Kobayashi.

Unfortunately, multiple lubrication passages increase the cost of the compressor while not necessarily improving the lubrication of the assembly. Furthermore, special problems can arise when the compressor is tilted or mounted in such a way that the oil collects in one portion of an oil sump or reservoir which is remote from an oil return passage. In these cases and despite an otherwise well designed lubrication circuit, little or no oil is returned to the working elements of the compressor.

SUMMARY OF THE INVENTION AND ADVANTAGES

The subject invention overcomes the problems of the prior art in a compressor having a simple yet highly efficient lubrication circuit which piggy backs on other passages necessary for purposes other than lubrication and which is operable regardless of the angulatory orientation of the compressor.

More specifically, the subject invention is directed toward a fluid pumping assembly including a housing defining a crank case and a head. The head includes a suction chamber and a discharge chamber. The crank case operates at a first pressure and the discharge pressure operates at a second elevated pressure. A control valve is mounted in a control valve boss and has an inlet exposed to the second elevated discharge pressure and an outlet exposed to the first crank case pressure. The control valve is responsive to pressure differentials between the crank case and the discharge chamber and provides a fluid path between the crank case and the discharge chamber to allow lubricating fluid from the discharge chamber to be injected into the crank case through the fluid path provided by the control valve under the influence of the pressure differential existing between the crank case and the discharge chamber. The control valve boss partially bifurcates the discharge chamber to form first and second lubrication reservoirs such that oil is disposed on either side of the control valve boss and in the first and second reservoirs. The assembly is characterized by including an oil pick-up tube for providing fluid communication between the control valve inlet and the first and second oil reservoirs on either side of the control valve boss for delivering oil from both the first and second reservoirs to the control valve inlet regardless of the orientation of the housing of the fluid pumping assembly.

The subject invention overcomes the problems associated with the prior art in an oil return tube which provides fluid communication between a control valve and an oil reservoir in the discharge chamber. In the past, the control valve employed in conjunction with the subject invention was dedicated to monitoring the pressure differential between, for example, the crank case and the discharge chamber in the compressor to vary the displacement of the compressor as disclosed, for example, in U.S. Pat. No. 4,428,718 issued to Skinner on Jan. 13, 1984 and assigned to the assignee of the present invention. Control valves such as those disclosed in the Skinner '718 patent and used in conjunction with the subject invention are housed in a control valve boss located in the discharge chamber disposed in the head of a compressor. Portions of the discharge chamber adjacent the valve boss are also employed as oil sumps or reservoirs. Unfortunately, the control valve boss forms a partial barrier in the discharge chamber and sometimes results in lubricating oil pooling on one side of the boss remote from the operative end of an oil pick-up tube or lubrication passage. This condition leads to reduced oil recirculation and deficient lubrication of the compressor.

The subject invention employs the passages already existing in the control valve while at the same time overcoming the problem of oil pooling on either side of the control valve boss by providing fluid communication between the control valve and the oil reservoirs located on both sides of the control valve boss. In this way, adequate lubrication of the mechanical working parts of the compressor is ensured without the need for additional, complex and expensive porting and lubrication passages.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a cross-sectional view taken substantially along lines 2—2 of FIG. 1 and illustrating the location of the oil return tube relative to the control valve boss in the partially bifurcated discharge chamber of the fluid pumping assembly;

FIG. 3 is a front plan view of the oil return tube of the subject invention; and FIG. 4 is a side view of the oil return tube of the subject invention.

DETAILED DESCRIPTION OF THE PREFERRED EMBODIMENT

Figure 1:
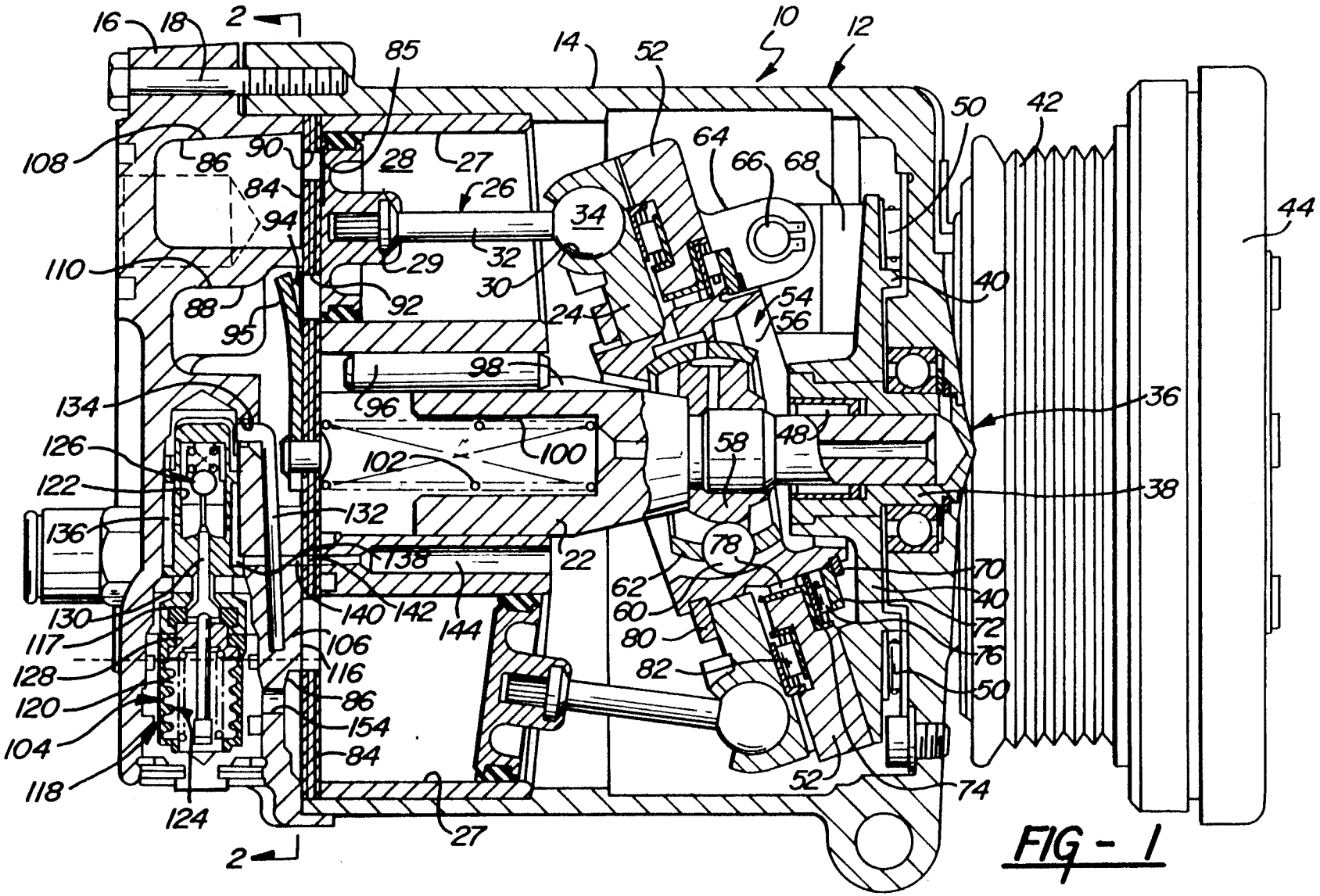
FIG. 1 is a cross-sectional side view of a fluid pumping assembly illustrating a lubrication circuit including an oil return tube providing fluid communication between the crank case and an oil reservoir in the discharge chamber through a control valve.

Referring to FIG. 1, a fluid pumping assembly having a lubrication circuit functioning independent of the orientation of the fluid pumping assembly is generally shown at 10. For purposes of description only and not by way of limitation, the subject invention will be described with respect to a refrigerant compressor 10 of the type for compressing a recirculated refrigerant fluid in an automotive air conditioning system having the normal condenser for condensing a refrigerant gas into a liquid, an orifice tube, evaporator and accumulator arranged in that order, (but not shown) between the compressor discharge and suction sides as is commonly known in the art.

The compressor 10 has a housing, generally indicated at 12, which includes a crank case 14 and a head 16. The head 16 is sealingly clamped and fixedly attached to one end of the crank case 14 via fasteners 18 and an O-ring (not shown).

The compressor assembly also includes a nonrotatable shaft 22 centrally supported in the crank case 14 of the housing 12. The shaft 22 has a longitudinal axis and will be described in greater detail below. A variable angle wobble plate 24 is mounted about the shaft 22. A plurality of piston assemblies, generally indicated at 26, are disposed parallel relative to one another and supported for reciprocal movement in the housing 12. More specifically, each of the piston assemblies 26 is spaced in equal angular increments about the housing 12 at equal radial increments from the longitudinal axis of the nonrotating shaft 22. Each piston assembly 26 is slidably reciprocated in axial cylinders 27 which define compression chambers 28. The wobble plate 24 includes a plurality of sockets 30 associated with each piston assembly 26 and spaced in equal angular increments about the radial edge of the wobble plate 24. Each piston assembly 26 includes a head 29 and a piston rod 32 connected to the back side of each head 29 in known fashion. The piston rod 32 terminates in a ball 34. The ball 34 is slidably received and supported in the socket 30 such that the head 29 is capable of reciprocal movement in the cylinder 26.

The assembly further includes a drive means, generally indicated at 36, and rotatably driven about the longitudinal axis of the nonrotating shaft 22 for driving the wobble plate 24 through angulatory movement relative to the shaft 22 and thereby reciprocating the piston assemblies 26 in the cylinders 27. The drive means 36 includes a drive member 38 and a hub 40 which is fixedly attached to and driven with the drive member 38. The drive member 38 is driven by a pulley 42 which, in turn, is operatively driven by an automotive engine in the refrigerant compressor assembly 10 of the preferred embodiment. An electromagnetic clutch 44 is employed to selectively engage and disengage the pulley 42 from the drive member 38. The crank case 14, through which lubricant which is entrained in the gaseous refrigerant is cycled, is sealed from the atmosphere at the top of the housing with a lip seal (not shown). Needle bearings 48 are employed at the interface of the drive member 38 and the nonrotating shaft 22 and radial thrust bearings 50 are used at the interface of the rotating hub 40 and the top of the crank case 14.

The drive means 36 of the compressor assembly 10 further includes a journal 52 which is axially retained relative to the shaft 22 on a constant velocity joint, generally indicated at 54, but rotatably driven by the hub 40 of the drive means 36 as will be described in further detail below. The constant velocity joint 54 is of the conventional type, well known in the art, and includes an outer race 56, an inner race 58 which is fixed to the nonrotating shaft 22 and a plurality of ball bearings 60 retained by a cage 62 disposed therebetween. The race 56 is nonrotatable but is capable of angulatory movement relative to the shaft 22.

The journal 52 includes an ear 64 extending away from the jounal 52 and which carries a cross pin 66. The hub 40 includes a lug 68 which extends toward the ear 64 and which includes an arcuate guide slot (not shown). The cross pin 66 is carried in the guide slot and is adjustable therein according to the position of the wobble plate 24 in the housing and the relative angle of the wobble plate 24 relative to the shaft 22. The interaction of the hub 40 and driven journal 52 are like that disclosed in greater detail in U.S. Pat. Nos. 4,175,915 and 4,297,085 both of which are assigned to the assignee of this invention, and is commonly known in the art.

The journal 52 is axially retained on the constant velocity joint 54 relative to the shaft 22 by the combination of a retaining ring 70 and thrust washer 72. The retaining ring 70 is fixed to an outer end surface portion of the outer race 56 of the constant velocity joint 54. It holds the thrust washer 72 against movement with respect to the journal 52. The journal 52 includes an annular stepped surface 74 near its inner diameter. A needle type thrust bearing 76 is disposed between the thrust washer 72 and the stepped surface 74. Similarly, radial needle bearings 78 are disposed between the inner diameter of the journal 52 and the outer surface of the outer race 56 of the constant velocity joint 54.

The wobble plate 24 is axially retained on the constant velocity joint 54 relative to the shaft 22 by a retaining ring 80 disposed opposite the journal retaining ring 70. An annular thrust bearing 82 is employed between the interface of the wobble plate 24 and the journal 52 to allow for the relative rotation of the journal 52 with respect to the wobble plate 24 while driving the wobble plate 24 through angulatory movement relative to the shaft 22. In this way, as the hub 40 of the drive means 36 rotatably drives the journal 52, the nonrotatable wobble plate 24 is driven through angulatory movement relative to the shaft 22, thereby reciprocating the pistons 26 in the cylinder 27.

A valve plate 84 is fixedly clamped between the head 16 and the crank case 14. The head 16 includes a suction chamber 86 for receiving gaseous refrigerant via an inlet port (not shown) in communication with the accumulator (not shown). The head 16 further includes a discharge chamber 88 from which gaseous refrigerant is pumped to a condenser (not shown). Inlet passages 90 in the valve plate 84 are covered by one-way reed valves 85 operative to provide fluid communication between the suction chamber 86 and the compression chamber 28. Outlet passages 92 are included in the valve plate 84 to provide fluid communication between the compression chambers 28 through one way flapper valves 94 backed by valve stops 95, or the like, and the discharge chamber 88.

The compressor assembly 10 of the subject invention pumps gaseous refrigerant in the following manner. During the intake stroke of the pistons 26 the refrigerant is drawn into the suction chamber 86 through the inlet passage 90 up into the compression chamber 28. During the compression stroke of the pistons 26, the refrigerant is pumped out of the compression chamber 28 through the outlet passage 92, into the discharge chamber 88 and ultimately through the condenser.

As mentioned above, the compressor assembly 10 further includes a shaft 22 which is nonrotatably and centrally supported in the housing 12 but moveable coaxial of the longitudinal axis to predetermined points to adjust the position of the wobble plate 24 thereby varying displacement of the compressor 10. The shaft 22 is centrally supported in the crank case 14 adjacent to and surrounded by the cylinders 24. The assembly 10 further includes at least one key 96 fixedly disposed between a cylinder 27 and a shaft 22 and extending parallel to the longitudinal axis of the shaft 22. The shaft 22 includes a notch 98 which also extends parallel to the longitudinal axis of the shaft 22. The key 96 is in abutting and sliding contact with the longitudinally extending notch 98 of the shaft 22 to prevent rotation of the shaft 22 but allowing movement coaxial of the longitudinal axis of the shaft 22. A bore 100 is disposed in one end of the shaft 22 and a helical coil return spring 102 is biased with a predetermined force between the terminal end of the bore 100 and the shaft 22 and the valve plate 84.

The shaft 22 is axially moveable in the housing 12 in response to pressure differentials existing between the crank case 14 and the suction 86 and discharge chambers 88. More specifically, the crank case 14 operates at a first lower predetermined pressure and the discharge chamber 88 operates at a second elevated predetermined pressure. A control valve arrangement, generally indicated at 104, is mounted in the control valve boss 106 disposed in the head 16 and functions in response to pressure differentials between the crank case 14 and the suction and discharge chamber 86, 88, respectively, to control the angle of the wobble plate 24 relative to the axis of the shaft 22 in order to vary the displacement of each of the pistons 26 within their respective compression chambers 28. Furthermore, and according to the subject invention, the control valve 104 provides a fluid path between the crank case 14 and the discharge chamber 88 to allow lubricating fluid from the discharge chamber to be injected into the crank case 14, through the fluid path provided by the control valve 104 under the influence of the pressure differential existing between the crank case 14 and the discharge chamber 88.

In compressors employing control valves of the type described herein, the angle of the wobble plate is determined by a force balance on the pistons wherein a slight elevation of the crank case—suction pressure differential above a set suction pressure control point creates a net force on the pistons that acts to reduce the wobble plate angle and thereby reduce the compressor capacity. Control valves of this type are also responsive to compressor suction pressure and operate when the air conditioning capacity demand is high and the resulting suction pressure rises above the control point so as to maintain a bleed from crank case to suction so there is a minimal crank case—suction pressure differential. As a result, the wobble plate 24 will then angle to its full stroke large angle position shown in FIG. 1 establishing maximum displacement. On the other hand, when the air conditioning capacity demand is lowered and the suction pressure falls to the control point, the control valve with just the suction pressure bias then operates to close off the crank case connection with suction and either provide communication between the compressor discharge and the crank case or allow the pressure therein to increase as a result of gas blow by past the pistons. This has the effect of increasing the crank case-suction pressure differential which on slight elevation creates a net force on the pistons that reduces the wobble plate angle and thereby reduces the compressor displacement.

The variable displacement control valve 104 and associated structure is similar to that disclosed in U.S. Pat. No. 4,428,718 assigned to the assignee of this invention, and is hereby incorporated by reference in its entirety. As such, only the features of the control valve 104 which are pertinent to the subject invention will be discussed in detail below.

Referring now to FIGS. 1 and 2, it can be seen that the suction and discharge chambers 86, 88, respectively, are defined by side walls 108, 110 which form concentric circles when viewed in FIG. 2. The control valve boss 106 extends from one edge of the discharge chamber side wall 110 toward the center of the concentric circles defined by the side walls 108, 110 of the suction and discharge chambers 86, 88 and partially bifurcates the discharge chamber 88 to form first and second reservoirs 112, 114, respectively. The control valve boss 106 extends from the floor of the discharge chamber 88 across the depth of the discharge chamber 88 and includes surface 116 which is disposed in abutting side-by-side relationship with the valve plate 84.

Compressors of the type employed in automotive air conditioning applications are commonly mounted on their sides, as viewed in FIG. 1, in various angulatory orientations depending on the space available in the engine compartment, mounting requirements and the location of available mounting structure. As such, in the operative mode, lubricating fluid such as oil, which is collected in the discharge chamber pending redistribution through the compressor, tends to pool on either side of the control valve boss 106 and in the first and second reservoirs 112, 114.

In the past, when the oil pooled in only one of the reservoirs on one side of the control valve boss 106 and remote from any remote pick-up or lubrication passage which may have been located on the other side of the boss, the oil available for redistribution to the working elements of the compressor was drastically reduced. The subject invention overcomes this problem while employing the fluid passageways between the discharge chamber 88 and the crank case 114 through the control valve 104.

The control valve 104 includes a housing 117 having a stepped bore generally indicated at 118, having a larger bore portion 120 and a smaller bore portion 122 disposed at opposite ends of the stepped bore 118 relative to one another. A springed biased bellows assembly, generally indicated at 124, is disposed in the larger bore 120 and a check valve assembly, generally indicated at 126, is disposed in the smaller bore 122. A cap member 128 is seated on one end of the bellows assembly 124 and a push rod 130 extends between the cap member 128 and the check valve assembly 126.

A lubrication pick-up tube 132 provides fluid communication between the smaller bore portion 122, through a control valve inlet 134 and the first and second reservoirs 112, 114 on either side of the control valve boss 106. The first and second reservoirs 112 and 114 operate at the discharge pressure and therefore expose the control valve inlet 134 to this pressure. The control valve 104 further includes a chamber 136 located just to one side of the check valve assembly 126 and between this assembly and the cap member 128. This chamber 136 is exposed to crank case pressure via outlet 138 and passages 140, 142 and 144 extending through the valve boss 106 valve plate 84 and structure of the crank case 14, respectively.

As shown in FIGS. 2, 3 and 4, the lubrication pick-up tube 132 includes a hollow tubular U-shaped tube defining an arched portion 148 straddling the control valve boss 106 and having first and second terminal ends 149, 150, respectively, disposed in the first and second reservoirs 112, 114, respectively. The pick-up tube 132 further includes a delivery portion 152 which is disposed on the arched portion 148 of the U-shaped tube 132 and extends perpendicular thereto. The delivery portion 152 is adapted to be received in the inlet 134 of the control valve 104 for providing fluid communication from both the first and second reservoirs 112, 114, through the first and second terminal ends 149, 150 and then through the delivery portion 152 and into the control valve inlet 134.

Oil is delivered from the first and second reservoirs 112, 114 through the lubrication pick-up tube 132 and a control valve 104 to the crank case 14 in the following manner. The pressure in the suction chamber 86 acts on the bellows 124 of the control valve 104 via passage 154 to expand or contract the bellows 124. When the pressure in the suction chamber 86 has dropped below a predetermined point, the bellows 124 will expand driving the cap member 128 against the push rod 130 thereby unseating the ball in the check valve assembly 126. When this occurs, fluid communication is established between the discharge chamber 88 and the crank case 14 through the pick-up tube 132 and the control valve 104. More specifically, under the influence of the higher pressure of the discharge chamber 88, oil will flow from the first and second reservoirs 112, 114, through the U-shaped pick-up tube 132 and the inlet 134 into the smaller bore portion 122. The oil will then flow through the check valve assembly 126 into the chamber 136 through the outlet 138 and then along passages 140, 142 and 144 into the crank case 14.

In this way, the pick-up tube 132 of the subject invention employs the pressure differentials existing between the discharge chamber 88 and the crank case 14 to deliver oil from the two possible reservoirs in the discharge chamber 88, through the control valve 104 and the existing passageways previously dedicated to monitoring the pressure differentials and into the crank case 14. Further, the U-shaped pick-up tube 132 is specifically designed to provide this passageway from the reservoirs irrespective of the orientation of the compressor.

The invention has been described in an illustrative manner and it is to be understood that the terminology which is used is intended to be in the nature of words of description rather than of limitation.

Obviously, many modifications and variations of the present invention are possible in light of the above teachings. It is, therefore, to be understood that within the scope of the appended claims, the invention may be practiced, otherwise than as specifically described.

We claim:

1. In a fluid pumping assembly having a wobble plate connected to pistons the pistons being positioned by the wobble plate as it assumes different operating angles to vary the stroke of the pistons and thereby the capacity of the fluid pumping assembly the improvement comprising;

a housing defining a crank case and a head, said head including a suction chamber and a discharge chamber, said crankcase operating at a first pressure and said discharge chamber operating at a second elevated pressure and the differential between said first pressure and said discharge chamber determining the operating angle of said wobble plate;

said housing including a generally circular side wall partially defining said discharge chamber;

a control valve boss on said housing extending upwardly within housing from the low point of said side wall; control valve means mounted in said control valve boss; said control valve means having an inlet raised from and located out of fluid communication with said low point; said control valve means further having an outlet exposed to said first crank case pressure;

said control valve boss partially bifurcating said discharge chamber and including side surfaces thereon connected to said side wall adjacent said low point of said discharge chamber to form first and second reservoirs that trap lubricant flowing into said discharge chamber; and means for returning the trapped lubricant back to the crank case; said means including a tube having a first open end connected to said control valve means inlet and second and third open ends disposed respectively within said first and second reservoirs for directing said second elevated discharge pressure through said tube and into said control valve through said inlet thereof;

said control valve means including means responsive to pressure differentials between said crank case pressure and said discharge pressure for controlling pressure differential across said pistons for producing a net force on said wobble plate for varying the operating angle thereof; and said control valve means and said tube combining to provide a fluid path from said discharge chamber at the low point of said first and second reservoirs and back to said crank case for directing trapped lubricant under pressure from said first and second reservoirs thence through said first open end of said tube and upwardly through said tube and into said control valve means inlet thence through said control valve means for return flow into said crankcase.

2. An assembly as set forth in claim 1 further characterized by said tube being a hollow tubular U-shaped tube defining an arched portion straddling said control valve boss and having first and second terminal ends disposed in said first and second reservoirs respectively, and also having a delivery portion disposed on said arched portion of said U-shaped tube and extending perpendicular thereto, said delivery portion adapted to be received in said inlet of said control valve for providing fluid communication from both said first and second reservoirs, through said first and second terminal ends of said U-shaped pick-up tube, through said delivery portion and into said control valve inlet.

* * * * *